United States Patent [19]

Aoki et al.

[11] Patent Number: 4,492,191

[45] Date of Patent: Jan. 8, 1985

[54] FUEL CUT-OFF DEVICE FOR FUEL INJECTION PUMPS FOR MULTI-CYLINDER INTERNAL COMBUSTION ENGINES

[75] Inventors: Fujio Aoki; Hiroshi Isobe, both of Higashimatsuyama, Japan

[73] Assignee: Diesel Kiki Co., Ltd., Saitama, Japan

[21] Appl. No.: 468,397

[22] Filed: Feb. 22, 1983

[30] Foreign Application Priority Data

Mar. 2, 1982 [JP] Japan ..... 57-29168[U]

[51] Int. Cl.[3] ..... F02D 17/02

[52] U.S. Cl. ..... 123/198 F; 123/481; 123/446

[58] Field of Search ..... 123/198 F, 481, 446, 123/198 D, 198 DB

[56] References Cited

U.S. PATENT DOCUMENTS

| | | | |
|---|---|---|---|
| 2,875,742 | 3/1959 | Dolza | 123/481 |
| 4,098,252 | 7/1978 | Abthoff et al. | 123/198 F |
| 4,148,289 | 4/1979 | Hewitt | 123/198 D |
| 4,150,651 | 4/1979 | Wade et al. | 123/198 F |
| 4,297,979 | 11/1981 | Kamleitner | 123/198 F |
| 4,393,825 | 7/1983 | Breeck et al. | 123/198 F |

*Primary Examiner*—Ira S. Lazarus

*Attorney, Agent, or Firm*—Frishauf, Holtz, Goodman & Woodward

[57] ABSTRACT

Three way valves forming a fuel cut-off valve are arranged across respective injection pipes connected to injection nozzles associated with preselected cylinders of the engine. In a first valve position, the three way valves connect the injection pump body or bodies of the fuel injection pump to the respective injection pipes, and in a second valve position, they connect the injection pump body or bodies to a lower pressure zone in the pump. Preferably, the fuel cut-off valve is pneumatically operated for high speed valve position changing action.

5 Claims, 2 Drawing Figures

FUEL CUT-OFF DEVICE FOR FUEL INJECTION PUMPS FOR MULTI-CYLINDER INTERNAL COMBUSTION ENGINES

BACKGROUND OF THE INVENTION

This invention relates to fuel injection pumps for multi-cylinder internal combustion engines, and more particularly to a fuel cut-off device for fuel injection pumps of this type.

It has conventionally been carried out to cut off the supply of fuel to preselected cylinders of a multi-cylinder internal combustion engine to interrupt fuel injection into these cylinders during operation of the engine, for so-called "partial cylinder operation" during low speed running or for use of the cylinders as compressors for supplying compressed air. For instance, at engine idle, the partial cylinder operation is carried out wherein the supply of fuel to part of the cylinders is cut off so as to supply the other operating cylinders with an adequate amount of fuel in order to achieve stable idling operation of the engine as well as improved emission characteristics of same. Further, if carried out during low load operation such as running on a downward slope or low speed running during a traffic jam, the partial cylinder operation of an automobile engine will enable saving the fuel cost, contributing to the recent demand for energy saving. As another example, the fuel-cut cylinders are used as compressors to utilize the resultant compressed air for transferring fodder from a fodder tank in a silo to a transport container, etc.

A conventional typical fuel cut-off device of this kind is constructed as follows: A fuel feeding line is divided into a first portion connected to a group of fuel injection units to be subjected to cutting-off of fuel, and a second portion connected to another group of fuel injection units to be permently supplied with fuel during operation. A fuel cut-off valve is arranged across the first portion of the fuel feeding line at a location upstream of the first group of fuel injection units, which is closed when it is required to cut off the supply of fuel to the same group of fuel injection units.

However, since the fuel cut-off valve is arranged upstream of the fuel injection units to be subjected to cutting-off of fuel as above, the fuel injection does not terminate until all the fuel within the fuel injection units is injected after closing of the fuel cut-off valve. Also, when the fuel cut-off valve is opened to resume or start the fuel injection, the fuel injection does not start until after fuel has been supplied into the fuel injection units to a sufficient amount after the opening of the fuel cut-off valve.

SUMMARY OF THE INVENTION

It is the object of the invention to provide a fuel cut-off device for a fuel injection pump for use with a multi-cylinder internal combustion engine, which is capable of cutting off and starting or resuming the supply of fuel to preselected cylinders of the engine, in very small periods of time after it is actuated.

The fuel cut-off device according to the present invention comprises a fuel cut-off valve formed of at least one three way valve arranged across an injection pipe, which is connected to an injection nozzle associated with at least one preselected cylinder of the internal combustion engine, and operating means for changing the valve position of the three way valve. In a first valve position, the three way valve connects its associated injection pump body to the above injection pipe, while in a second valve position, it connects the injection pump body to a return fuel line leading to a lower pressure zone in the fuel injection pump, for instance. Thus, when the three way valve is changed to the first valve position, fuel pumped by the injection pump body is promptly delivered to the injection nozzle through the three way valve and the injection pipe, and when the valve is changed to the second valve position, the delivery of pumped fuel to the above injection nozzle is immediately interrupted and simultaneously the pumped fuel is returned to the lower pressure zone in the pump through the return line.

The above and other objects, features and advantages of the invention will be more apparent from the ensuing detailed description taken in connection with the accompanying drawings.

DETAILED DESCRIPTION

Figure 1:
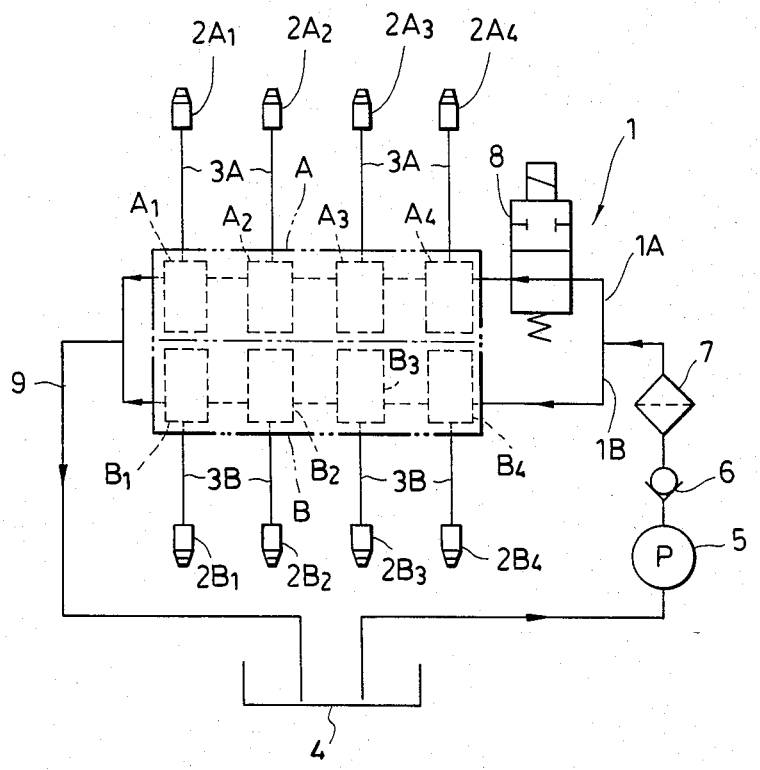
FIG. 1 PRIOR ART
FIG. 1 is a schematic diagrammatic view of a conventional fuel cut-off device for a fuel injection pump for multi-cylinder internal combustion engines.

Referring to FIG. 1, there is illustrated a conventional fuel cut-off device and an in-line type fuel injection pump for multi-cylinder internal combustion engines, on which the fuel cut-off device is mounted. In the figure, the fuel injection pump 1 comprises two banks of fuel injection units A and B. Each bank of the fuel injection units A, B comprises four injection poump bodies $A_1 \ldots A_4$, $B_1 \ldots B_4$, fuel feeding lines 1A and 1B connected to the suction sides of the respective injection pump bodies, four injection pipes $3A_1 \ldots 3A_4$, $3B_1 \ldots 3B_4$ connected to the delivery sides of the respective injection pump bodies, and injection nozzles $2A_1 \ldots 2A_4$, $2B_1 \ldots 2B_4$ connected, on one hand, to the respective injection pipes and mounted, on the other hand, on the respective cylinders of an associated engine, not shown. A fuel cut-off valve 8, which is formed of a two port/two position solenoid valve in the illustrated embodiment, is arranged across the fuel feeding line 1A which is joined with the other fuel feeding line 1B at a location upstream of the fuel cut-off valve 8, and the joined fuel feeding line leads to a fuel tank 4 by way of a filter 7, a check valve 6 and a feed pump 5. Fuel in the fuel tank 5 is sucked by the feed pump 5, fed through the check valve 6 and the filter 7, and divided into two flows in the fuel feeding lines 1A, 1B. The fuel in the line 1A passes through the fuel cut-off valve 8, which is opened in the illustrated position, to be fed to the injection pump bodies $A_1 \ldots A_4$ of the first bank, while on the other hand, the fuel in the line 1B is directly fed to the injection pump bodies $B_1 \ldots B_4$ of the second bank. Then, the fuel is pumped by the injection pump bodies into the injection pipes $3A_1 \ldots 3A_4$, $3B_1 \ldots 3B_4$ and injection nozzles $2A_1 \ldots 2A_4$, $2B_1 \ldots 2B_4$ to be injected into the cylinders of the engine. Excessive fuel in the fuel injection units A A, B is spilled into an overflow line 9 and returned to the fuel tank 4.

According to the above conventional fuel cut-off device for fuel injection pumps, to cut off the supply of fuel to the one bank, i.e. the fuel injection unit A, the fuel cut-off valve 8 is operated to its closed position to cut off the supply of fuel to the fuel feeding line 1A. Then, the engine is operated in "one-bank operation" mode wherein the other bank of fuel injection units B alone are operative. However, since the fuel cut-off valve 8 is arranged at the inlet of the one fuel feeding line 1A, even when the fuel cut-off valve 8 is closed, the fuel injection is not interrupted until after all the fuel within the fuel injection units A has been injected. On the other hand, even when the fuel cut-off valve 8 is opened to start or resume the fuel injection, the fuel injection is not started until after fuel has been charged into the fuel injection units A to a sufficient amount. Thus, with the conventional fuel cut arrangement, actually it takes about 5–7 seconds to completely cut off the fuel injection after closing of the fuel cut-off valve 8, and its takes at least 1 second to resume the fuel injection after opening of the fuel cut-off valve 8.

Figure 2:
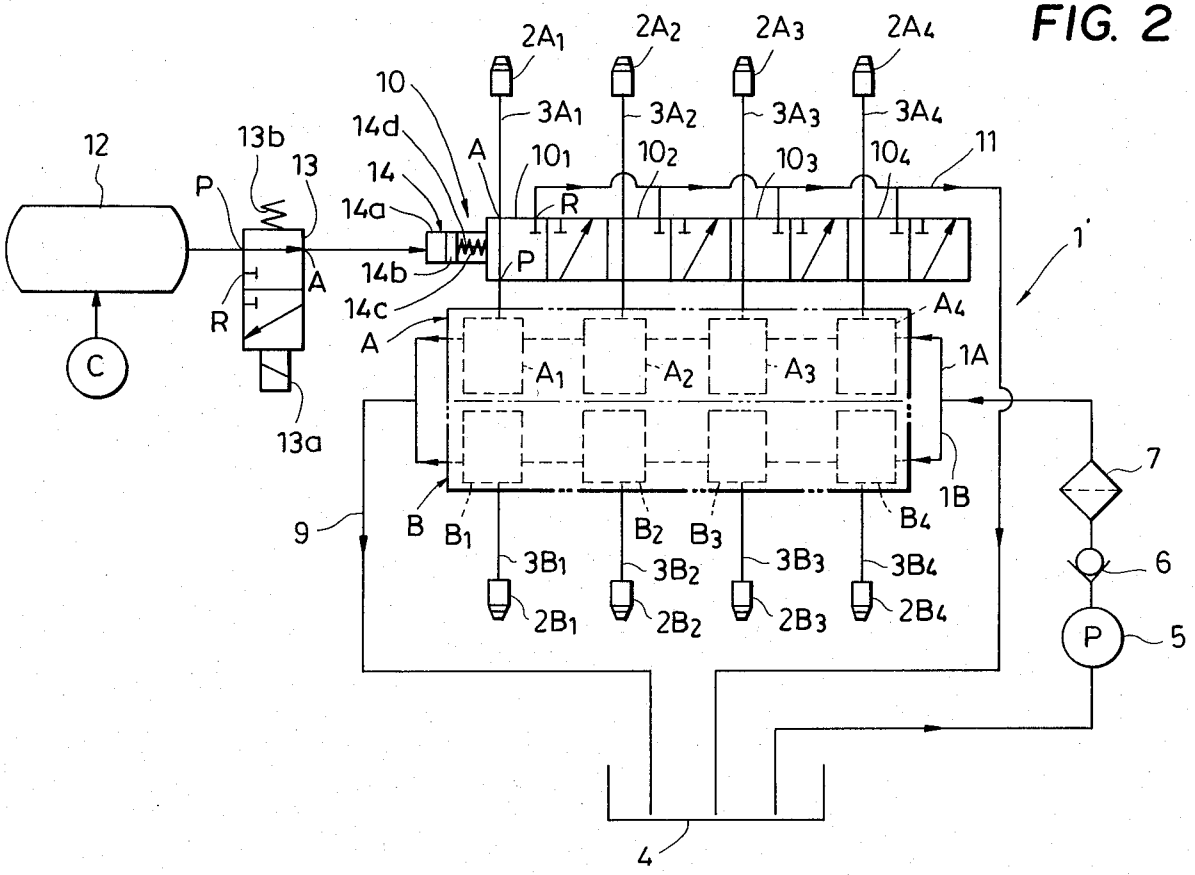
FIG. 2 is a schematic diagrammatic view of a fuel cut-off device according to an embodiment of the present invention.

The present invention will now be described with reference to FIG. 2 illustrating an embodiment thereof. In FIG. 2, parts or elements identical with those in FIG. 1 are designated by like reference numerals. A fuel injection pump 1' to which the invention is applied comprises two banks of fuel injection units A and B, each of which is formed of four injection pump bodies $A_1 \ldots A_4$, $B_1 \ldots B_4$, fuel feeding lines 1A and 1B connected to the suction sides of the injection pump bodies of the respective banks, four injection pipes $3A_1 \ldots 3A_4$, $3B_1 \ldots 3B_4$ connected to the discharge sides of the respective injection pump bodies, and four injection nozzles $2A_1 \ldots 2A_4$, $2B_1 \ldots 2B_4$ connected, on one hand, to the respective injection pipes and mounted, on the other hand, on an associated engine, not shown. The two fuel feeding lines 1A, 1B are joined together at a location upstream of the injection pump bodies and the joined fuel feeding line leads to a fuel tank 4 by way of a filter 7, a check valve 6 and a feed pump 5. Fuel sucked from the fuel tank 4 by the feed pump 5 is fed through the check valve 6 and the filter 7 and divided into two flows in the fuel feeding lines 1A, 1B. Then, the flows of fuel in the two divided lines 1A, 1B are fed to the injection pump bodies $A_1 \ldots A_4$, $B_1 \ldots B_4$ of the respective banks, pumped therefrom into the respective injection pipes $3A_1 \ldots 3A_4$, $3_{B1} \ldots 3B_4$, and then injected into the cylinders of the engine through the injection nozzles. The arrangement and operation of the fuel cut-off device of the present invention described above are substantially identical with those of the conventional one previously described with reference to FIG. 1. According to the present invention, a fuel cut-off valve 10 is provided which is formed of four three ways valves, i.e. three port/two position selector valves $10_1 \ldots 10_4$ arranged across the respective injection pipes $3A_1 \ldots 3A_4$ of one bank of fuel injection units A. The selector valves $10_1 \ldots 10_1$ each have a port P connected to a corresponding one of the injection pump bodies $A_1 \ldots A_4$, a port A connected to a side of a corresponding one of the injection pipes $3A_1 \ldots 3A_4$ toward the injection nozzles $2_{A1} \ldots 2A_4$, and a port R connected to the fuel tank 4 through a common return fuel line 11. The selector valves $10_1 \ldots 10_4$ are juxaposed to each other, and have their valve bodies operatively connected to each other for valve position changing actions in unison with each other. When the selector valves are in a first valve position where the port P and the port A in each selector valve communicate with each other, fuel pumped from the injection pump bodies $A_1 \ldots A_4$ is injected into the engine cylinders through the respective selector valves $10_1 \ldots 10_4$, the injection pipes $3A_1 \ldots 3A_4$ and the injection nozzles $2A_1 \ldots 2A_4$. At a second valve position of the selector valves where the port P communicates with its corresponding port R, the pumped fuel is discharged into the common return fuel line 11 through the selector valves and returned to the fuel tank 4.

The fuel cut-off valve 10 is further provided with an air cylinder 14 comprised of a cylinder **14*a*, a piston 14*b* received within the cylinder 14*a*, a rod 14*d* connecting the piston with the operatively connected valve bodies of the selector valves $10_1 \ldots 10_4$, and a return spring 14*c* urging the piston in one direction. Thus, the air cylinder 14 is drivingly connected to the selector valves $10_1 \ldots 10_4$ so that its internal pressure actuates them for synchronous valve position changing actions. On the other hand, the air cylinder 14 is connected to an air tank 12 by way of a solenoid operated control valve 13, the air tank 12 being also used as an accumulator for an air brake in a vehicle in which the engine is installed, for instance. Compressed air is accumulated in the air tank 12, which is supplied from a compressor C installed in the vehicle. The solenoid operated control valve 13 is formed of a three way valve (three port/two position valve) having a port P connected to the air tank 12, a port R opening in the atmosphere, and a port A connected to the air cylinder 14, as well as a solenoid 13*a* and a return spring 13*b***.

With the above arrangement, when the solenoid operated control valve 13 has its solenoid **13*a* deenergized, that is, it is in a first valve position as illustrated with the port P communicating with the port A, the pressurized air in the air tank 12 is supplied to the interior of the cylinder 14*a* of the air cylinder 14 through the control valve 13, whereby the pressure of the pressurized air urgingly displaces the piston 14*b* against the force of the return spring 14*c*, which in turn urges the mutually connected valve bodies of the selector valves $10_1 \ldots 10_4$ to change them into the first valve position so that fuel pumped from the injection pump bodies $A_1 \ldots A_4$ is delivered into the injection pipes $3A_1 \ldots 3A_4$ through the selector valves $10_1 \ldots 10_4$, to be injected into the engine cylinders through the injection nozzles $2A_1 \ldots 2A_4$. On the other hand, when the control valve 13 has its solenoid energized to be brought into a second valve position where the port A communicates with the port R, the air pressure in the air cylinder 14 is discharged into the atmosphere through the control valve 13, so that the valve bodies of the selector valves $10_1 \ldots 10_4$ are instantly returned to its original position together the piston 14*a* by the force of the return spring 14*c* to promptly change the selector valves $10_1 \ldots 10_4$ to the second valve position, resulting in interruption of the supply of fuel pumped from the injection pump bodies $A_1 \ldots A_4$ into the injection pipes $3A_1 \ldots 3A_4$. At the same time, the pumped fuel is returned to the fuel tank 4 through the return fuel line 11. According to the arrangement of the invention, since the amount of fuel is small in portions of the injection pipes $3A_1 \ldots 3A_4$ downstream of the fuel cut-off valve 10, the fuel injection is interrupted immediately after the change of the valve position of the fuel cut-off valve 10. Further, the arrangement that the air pressure within the air cylinder 14 is released into the atmosphere through the solenoid operated control valve 13 allows prompt returning action of the valve bodies of the selector valves $10_1 \ldots 10_4$ by the force of the return spring 14*c***, further advancing the termination of the fuel injection.

It has been experimentally ascertained that with the fuel cut-off device according to the invention the period of time from change of the valve position of the fuel cut-off valve to the termination of the fuel injection is within 0.5 second which is incomparably shorter than 5–7 seconds achieved by the conventional fuel cut-off device, and also the period of time from change of the valve position of the fuel cut-off valve to resumption of the fuel injection is within 1 second. Moreover, even when the engine is at rest, the air pressure accumulated in the air tank can actuate the fuel cut-off valve.

Although in the illustrated embodiment the fuel injection pump 1' is composed of two banks of fuel injection units A, B, one of which are subjected to cutting-off of fuel, the fuel injection pump units may be divided into any optional number of banks, any optional one of which may be subjected to cutting-off of fuel, to cut off the supply of fuel to any optional number of engine cylinders. Also, the fuel cut-off device according to the invention is not limited to the in-line type as illustrated, but may be applied to other types of fuel injection pumps, such as the distributor type.

While a preferred embodiment of the invention has been described, variations thereto will occur to those skilled in the art within the scope of the present inventive concepts which are delineated by the following claims.

What is claimed is:

1. In a fuel injection pump for an internal combustion engine having a plurality of cylinders, said fuel injection pump including a feed pump, at least one injection pump body connected to said feed pump, a plurality of injection nozzles mounted in said engine, and a plurality of injection pipes connected between said injection pump body and said injection nozzles, each of said injection pipes extending between said injection pump body and a corresponding one of said injection nozzle and supplying fuel pumped from injection pump body to said corresponding one injection nozzle, a fuel cut-off device comprising: at least one three way valve arranged across one of said injection pipes connected to one of said injection nozzles associated with at least preselected one of said cylinders of said engine; return fuel line means extending from said three way valve to a lower pressure zone; said three way valve being disposed to connect said injection pump body to said one injection pipe when it is in a first valve position thereof, and to connect said injection pump body to said return fuel line means when it is in a second valve position thereof; and operating means for changing the valve position of said three way valve; whereby when said three way valve is changed to said first valve position, fuel pumped from said injection pump body is immediately delivered to said one injection nozzle through said three way valve and said one injection pipe and injected into the engine, and when said three way valve is changed to said second valve position, said delivery of said pumped fuel to said one injection nozzle is immediately interrupted to interrupt said injection of said pumped fuel to the engine and simultaneously said pumped fuel is returned to said lower pressure zone through said return fuel line means.

2. A fuel cut-off device as claimed in claim 1, wherein said operating means comprises an air cylinder disposed to change the valve position of said three way valve, a pressurized air source, and a second three way valve connected between said air cylinder and said pressurized air source, said second three way valve being disposed to connect said pressurized air source to said air cylinder to allow supply of pressurized air from the former to the latter when it is in a first valve position thereof, and to communicate said air cylinder with the atmosphere when it is in a second valve position thereof.

3. A fuel cut-off device as claimed in claim 2, wherein said air cylinder comprises a cylinder disposed to be supplied with said pressurized air, a piston received within said cylinder to be acted upon by said pressurized air, said piston being drivingly connected to said three way valve, and a return spring urging said piston against the pressure of said pressurized air, whereby said pressurized air urgingly displaces said piston against the force of said return spring to change said three way valve to one of said first and second valve positions thereof.

4. A fuel cut-off device as claimed in claim 2, wherein said pressurized air source comprises a compressor installed in a vehicle on which said engine is installed, and an air tank accumulating therein compressed air supplied from said compressor.

5. A fuel cut-off device claimed in claim 1, wherein said at least one three way valve comprises at least two three way valves arranged, respectively, across at least two of said plurality of injection pipes, said at least two three way valves being adapted for synchronous valve position changing action between said first and second valve positions.

* * * * *